US007187895B2

(12) United States Patent
Nakano et al.

(10) Patent No.: US 7,187,895 B2
(45) Date of Patent: Mar. 6, 2007

(54) SHEET NIPPING MECHANISM AND IMAGE FORMING APPARATUS WITH SAME

(75) Inventors: Kuniaki Nakano, Osaka (JP); Yoshiharu Kanematsu, Osaka (JP)

(73) Assignee: Kyocera Mita Corporation (JP)

( * ) Notice: Subject to any disclaimer, the term of this patent is extended or adjusted under 35 U.S.C. 154(b) by 147 days.

(21) Appl. No.: 10/843,857

(22) Filed: May 12, 2004

(65) Prior Publication Data

US 2004/0234305 A1 Nov. 25, 2004

(30) Foreign Application Priority Data

May 12, 2003 (JP) ..... 2003-133333

(51) Int. Cl.
*G03G 15/20* (2006.01)

(52) U.S. Cl. ..... 399/322

(58) Field of Classification Search ..... 399/320–323, 399/328, 330–334, 339, 397, 400
See application file for complete search history.

(56) References Cited

U.S. PATENT DOCUMENTS

2002/0131801 A1* 9/2002 Tomatsu ..... 399/400
2004/0146323 A1* 7/2004 Fujisawa et al. ..... 399/323

FOREIGN PATENT DOCUMENTS

| | | | |
|---|---|---|---|
| JP | 61047978 A | * | 3/1986 |
| JP | 06138786 A | * | 5/1994 |
| JP | 9-114292 | | 5/1997 |
| JP | 2000-293060 | | 10/2000 |

* cited by examiner

*Primary Examiner*—David M. Gray
*Assistant Examiner*—Ryan Gleitz
(74) *Attorney, Agent, or Firm*—Gerald E. Hespos; Anthony J. Casella

(57) ABSTRACT

A sheet nipping mechanism is applied to an image forming apparatus and has a transfer belt for transporting a sheet having a toner image through a photosensitive drum. A fixing roller and a pressure roller are downstream of the transfer belt and are vertically aligned in a paired manner to define a nip zone therebetween for nipping the sheet. A guide is disposed between the nip zone and the downstream end of the transfer belt. The fixing roller has a reverse-crown shape whose diameter is gradually reduced in a direction extending from each of the opposite transverse ends to the central region of the fixing roller. The guide has an edge opposed to the nip zone and is formed in a crown shape conformable to the reverse-crown shape. The sheet nipping mechanism prevents crimples and bouncing of sheet in the nip zone.

19 Claims, 4 Drawing Sheets

SHEET NIPPING MECHANISM AND IMAGE FORMING APPARATUS WITH SAME

BACKGROUND OF THE INVENTION

1. Field of the Invention

The present invention relates to a sheet nipping mechanism applicable to an image forming apparatus, such as electrophotographic copiers, laser printers or facsimile machines. The present invention also relates to an image forming apparatus provided with the sheet nipping mechanism.

2. Description of the Related Art

There has heretofore been known a sheet nipping mechanism applied to an image forming apparatus as represented by electrophotographic copiers, laser printers or facsimile machines. This nipping mechanism is provided in a fixing device disposed downstream of a transfer belt for transporting a sheet having a toner image transferred thereonto through a photosensitive drum. The nipping mechanism comprises a fixing roller having a heater embedded therein, and a pressure roller disposed in opposed relation to the fixing roller while allowing the lower portion thereof to be in close contact with the fixing roller. The fixing roller is formed in a so-called reverse-crown (bow-tie-like, concave or reverse-tapered) shape whose diameter is gradually reduced in a direction extending from each of the opposite transverse ends to the central region of the fixing roller.

Thus, when a sheet is sandwiched between the fixing and pressure rollers, both transverse edges of the sheet are nipped more strongly than its central region to thereby receive forces oriented outward in opposite directions, respectively. The resulting tensile force prevents the sheet from being crimpled.

Such a nipping mechanism is disclosed, for example, in Japanese Parent Laid-Open Publication Nos. 9-114292 and 2000-293060. Specifically, the Japanese Parent Laid-Open Publication No. 9-114292 discloses a nipping mechanism in which each of fixing and pressure rollers is formed in a reverse-crown shape designed such that the amount of reverse crown in each of the rollers is set at 100 μm or more, and the total amount of reverse crown in the rollers is set in the range of 250 to 500 μm. Further, a guide plate to be disposed between a transfer belt and a nip zone is designed such that the height position of the guide plate is located below a line extending in a direction of the tangent to the nip zone between the fixing and pressure rollers. The publication describes that the nipping mechanism employing the above measure could drastically reduce crimples otherwise occurring on a sheet.

Further, the Japanese Parent Laid-Open Publication No. 2000-293060 discloses a nipping mechanism in which an embossed protrusion is formed in the transversely central region of a guide plate to be disposed between a transfer belt and a nip zone. The shape of the embossed protrusion is designed to guide a sheet being transported such that the trailing edge of the sheet is lowered as it gets close to the nip zone. The publication describes that the nipping mechanism employing the embossed protrusion can prevent image distortions due to bouncing in the trailing edge of a large-size sheet.

However, under the recent circumstances where the speeding up in the sheet-feeding and sheet-discharge to/from an image forming apparatus are driven forward, such a high-speed image forming apparatus is essentially required to have more enhanced nipping conditions for a sheet in a nip zone defined by fixing and pressure rollers. The conventional nipping mechanisms as disclosed in the Japanese Parent Laid-Open Publication Nos. 9-114292 and 2000-293060 cannot reliably prevent crimples occurring on a sheet in a nip zone and distortions in a transferred image due to the bouncing phenomenon, and it has been strongly expected to provide an improved nipping mechanism.

SUMMARY OF THE INVENTION

In view of the above circumstances, it is therefore an object of the present invention to provide a sheet nipping mechanism which can effectively suppress crimples occurring on a sheet in a nip zone and the bouncing phenomenon, and an image forming apparatus provided with the nipping mechanism.

According to an aspect of the present invention, a sheet nipping mechanism comprises a transport device for transporting a sheet having a toner image transferred thereonto through a photosensitive drum, a fixing device including a fixing roller and a pressure roller which are disposed on the side of the downstream end of the transport device and vertically aligned in a paired manner to define a nip zone therebetween, and a guide member disposed between the nip zone and the downstream end of the transport device. In this sheet nipping mechanism, the fixing roller is formed in a reverse-crown shape whose diameter is gradually reduced in a direction extending from each of the opposite transverse ends to the central region of the fixing roller. Further, the guide member has a downstream edge which is disposed in opposed relation to the peripheral surface of the fixing roller adjacent to the nip zone, and formed as a crown-shaped arc edge designed to allow the gap between the peripheral surface and the downstream edge to be set at an approximately constant value over its entire longitudinal length.

Other features and advantages of the present invention will be apparent from the accompanying drawings and from the detailed description.

DESCRIPTION OF THE PREFERRED EMBODIMENTS

Figure 1:
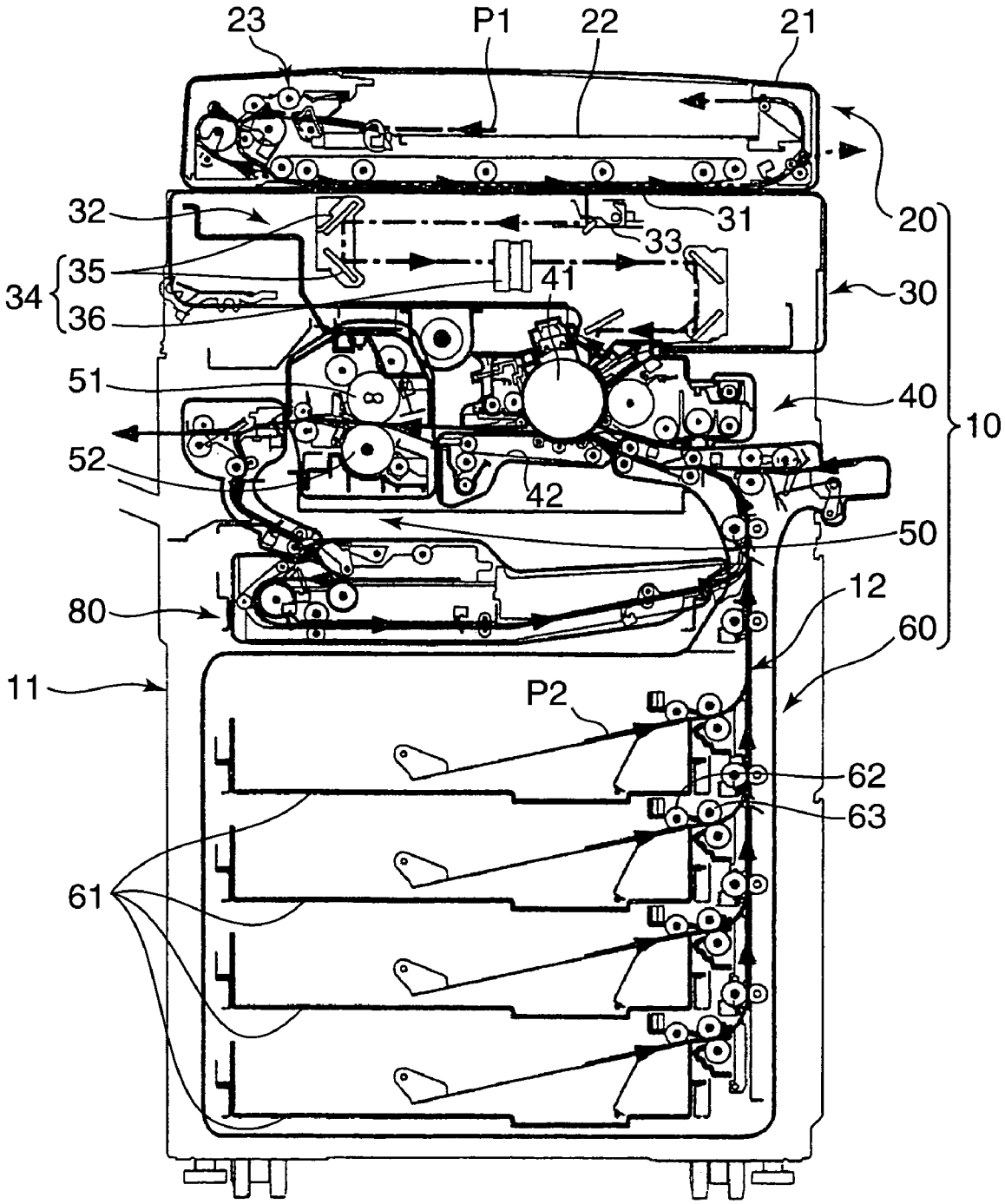
FIG. 1 is an explanatory sectional side view showing an image forming apparatus provided with a sheet nipping mechanism according to an embodiment of the present invention.

FIG. 1 is an explanatory sectional side view showing an image forming apparatus provided with a sheet nipping mechanism according to an embodiment of the present invention. As shown in FIG. 1, the image forming apparatus 10 fundamentally comprises a document load section 20 for loading a document P1 thereon, an image read section 30 for reading a document image from the document loaded on the document load section 20, a transfer section 40 for transferring the document image read through the document read section 30 to a sheet P2 in the form of a toner image, a fixing section 50 for fixing the toner image transferred on the sheet through the transfer section 40, and a sheet storage section 60 for storing sheets P2 to be fed toward the transfer section 40.

While the image read section 30, the transfer section 40, the fixing section 50 and the sheet storage section 60 are vertically mounted in this order within a box-shaped housing 11, the document load section 20 is formed as a separate body relative to the housing 11, and mounted on the top surface of the housing 11.

The document load section 20 includes an openable cover 21, a document tray 22 formed in the top surface of the cover 21 in the form of concavity, and a document feed mechanism 23 for feeding one of a bunch of documents P1 sequentially toward the document read section 30, and placing an document image of the document on the upper surface of the image read section 30 in opposed relation to one another.

The image read section 30 includes a contact glass 31 having an upper surface for allowing the surface of the document P1 having the document image to be placed thereon in a close contact manner, and an image read mechanism 32 for scanningly reading the document image in close contact with the contact glass 31. In this embodiment, the document read mechanism 32 includes a movable light source 33 for irradiating a document image with light in a continuously moving manner, and an optical system member 34 having a plurality of mirrors 35 for reflecting a light, which is emitted from the movable light source 33 and reflected at the document image, along a given optical path, and a lens member 36 for converging the light on the optical path.

The transfer section 40 includes a photosensitive drum 41 having a peripheral surface onto which a toner image is sequentially formed, and a transfer belt (transport device) for feeding a sheet P2 to the peripheral surface of the photosensitive drum 41. A scanned light resulting from the operation of scanning the document image of the document P1 and passing through the optical system member 34 is emitted onto the peripheral surface of the photosensitive drum 41 which is being rotated about its axis, to form an electrostatic image on the peripheral surface sequentially. Further, at a position downstream of the position where the scanned light is emitted, a development section 45 supplies toner to the electrostatic image to form a toner image on the peripheral surface of the photosensitive drum 41. Then, the toner image is transferred onto a sheet P2 fed through the transfer belt 42.

The fixing section 50 is operable to subject the transfer image of the sheet P2, which is transferred from the photosensitive drum 41 at the transfer section 40, to a fixing treatment. The fixing section 50 includes a fixing roller 51 having therein a heating member, such as a heating element capable of generating heat in response to current supplied thereto, and a pressure roller 52 disposed below and in opposed relation to the fixing roller 51. The sheet P2 discharged from the transfer section 40 in conjunction with the circular movement of the transfer belt 42 is fed between the fixing roller 51 and the pressure roller 52, and heated by the fixing roller 51 to fix the toner image on the sheet P2.

The sheet storage section 60 includes a plurality of tiered sheet cassettes 61 each retractably mounted inside the housing 11. Each of the sheet cassettes 61 is provided with a pickup roller 62 and a sheet-feeding roller 63 at one (right end in FIG. 1) of the end thereof. The uppermost one of stacked sheets P2 filled in the sheet cassette 61 is sequentially fed in conjunction with the rotational movement of the pickup roller 62, and discharged toward a transport path 12 through the sheet-feeding roller 63.

The sheet P2 discharged from the sheet cassette 61 through the pickup roller 62 and the sheet-feeding roller 63 is fed to the transfer section 40, and a toner image on the peripheral surface on the photosensitive drum 41 is transferred onto the sheet P2. Then, at the fixing section 50, the sheet P2 is subjected to the fixing treatment, and discharged outside the housing 11.

In this embodiment, a sheet-reversing section 80 is provided between the fixing section 50 and the sheet storage section 60. The sheet-reversing section 80 is used when a sheet P2 is subjected to a double-side printing treatment. More specifically, a sheet P2 having a first surface subjected to the fixing treatment at the fixing section 50 is temporality introduced into the sheet-reversing section 80. After the completion of an inversion treatment (reversing treatment), the sheet P2 is returned to the transfer section 40. The second surface of the sheet P2 is subjected to the transfer treatment at the transfer section 40 and the fixing treatment at the fixing section 50, and then the sheet P2 is discharged outside.

Figure 2:
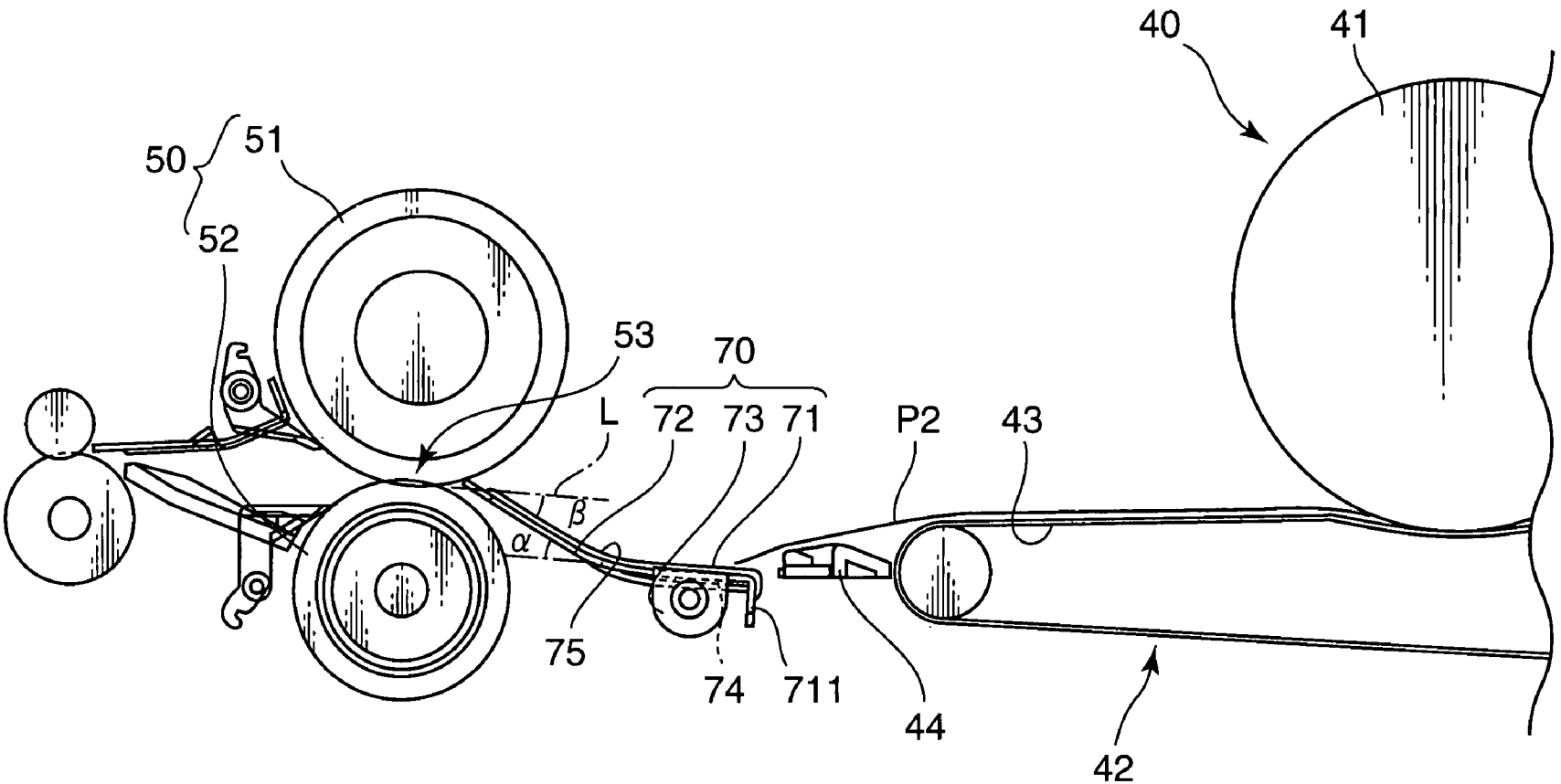
FIG. 2 is an explanatory side view of a mounted position of a guide member in the sheet nipping mechanism.
Figure 3:
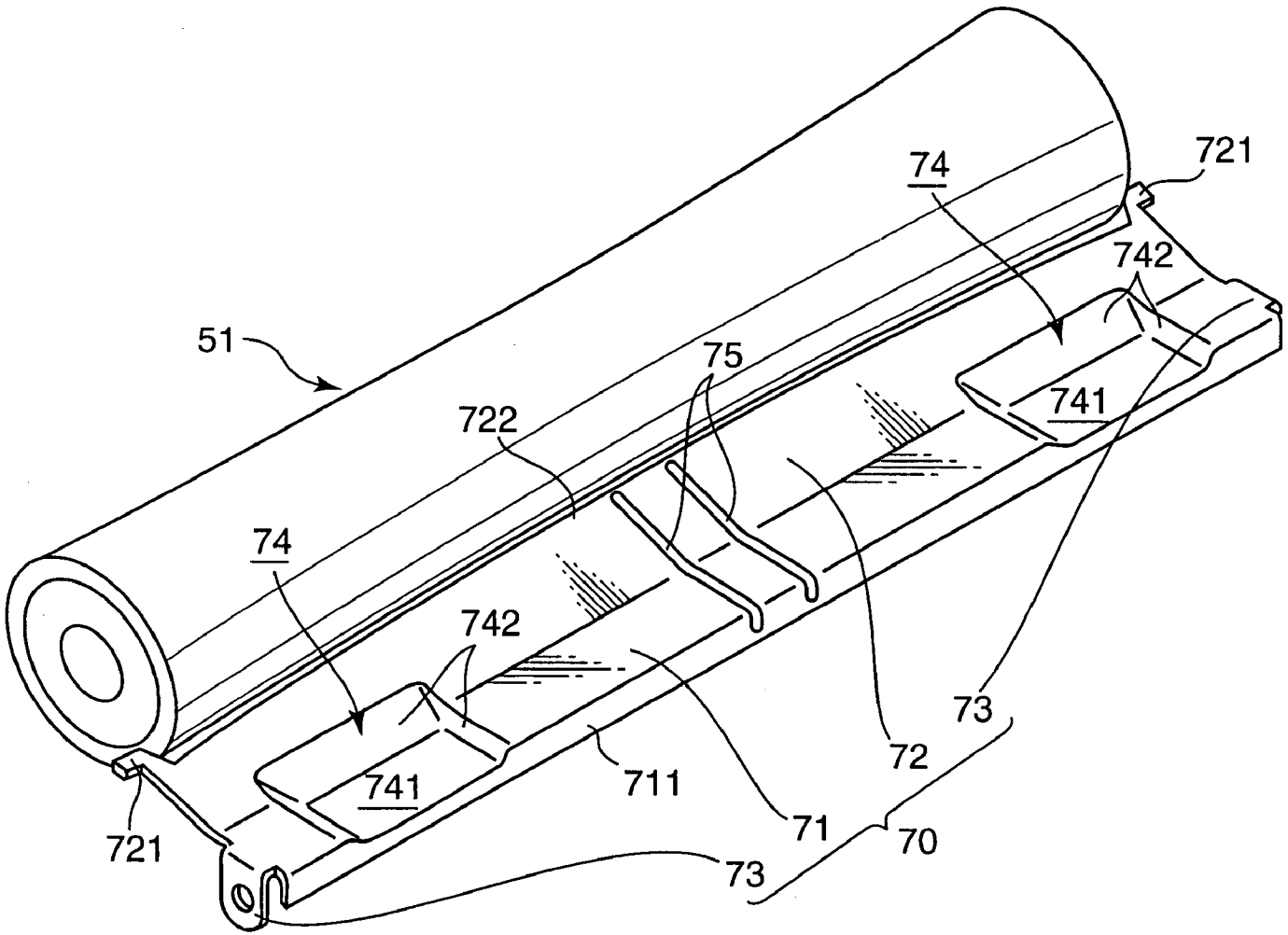
FIG. 3 is a perspective view of the guide member in FIG. 2.
Figure 4A:
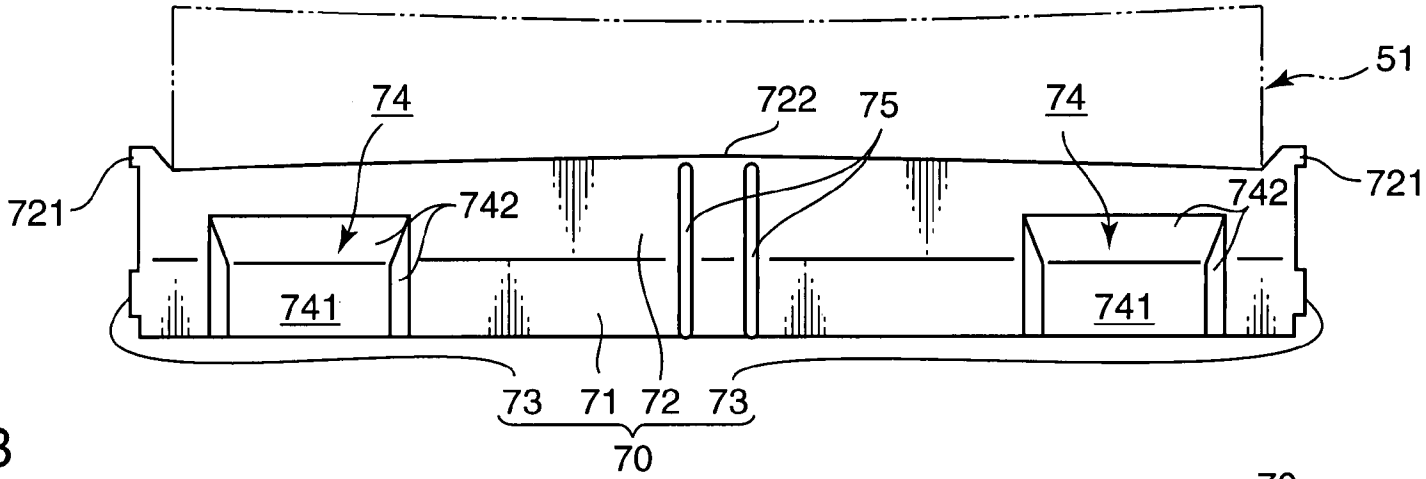
FIG. 4A is a top plan view of the guide member in FIG. 3.
Figure 4B:
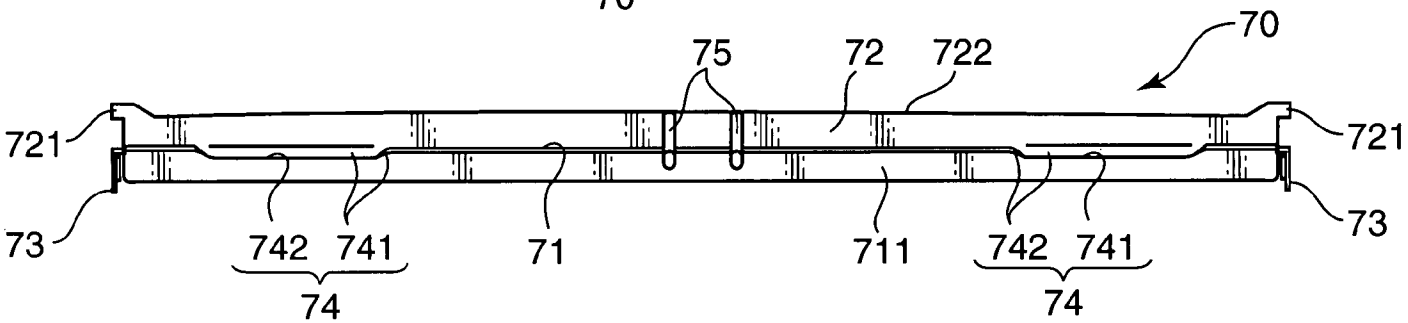
FIG. 4B is a front view of the guide member in FIG. 3.
Figure 4C:
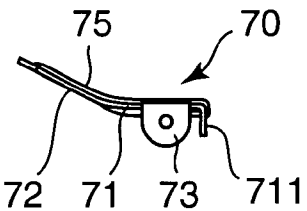
FIG. 4C is a side view of the guide member in FIG. 3.

In a sheet nipping mechanism according to an embodiment of the present invention, a guide member is provided between the transfer section 40 and the fixing section 50 so as to act as an intermediary for feeding a sheet P2 from the transfer section 40 to the fixing section 50. FIG. 2 is an explanatory side view of a mounted position of a guide member 70 in the sheet nipping mechanism according to the embodiment of the present invention. FIG. 3 is a perspective view of the guide member 70. FIGS. 4A, 4B and 4C are a top plan view, a front view and a side view of the guide member 70, respectively. In this embodiment, a pilot member 44 as illustrated in FIG. 2 is provided between the transfer belt 42 and the guide member 70. A sheet P2 transported through the transfer belt 42 is fed to the guide member 70 through the pilot member 44.

As shown in FIGS. 2 to 4, the guide member 70 includes a plate-shaped base portion 71 disposed approximately parallel with a transport surface 43 of the transfer belt 42, an inclined plate (inclined portion) 72 extending obliquely upward (obliquely leftward upward in FIG. 2) from the downstream end of the base portion 71 toward the contact position (hereinafter referred to as "nip zone 53") between the fixing roller 51 and the pressure roller 52, and a pair of brackets 73 formed by bending the respective transverse edges of the base portion 71 downward.

The pair of brackets 73 are used to attach the guide member 70 to a given frame in the housing 11. These brackets 73 are fixed to the given frame with screws or the like. The inclined plate 72 are formed with a pair of tubs 721 which protrude obliquely outward, respectively, from the opposite transverse edges adjacent to the downstream edge to get away from one another. These tubs 721 take a part of roll in positioning the guide member 70 in the housing 11 (for example, a roll of being supported).

The upstream edge (right edge in FIG. 2) of the base portion 71 is bent downward approximately at a right angle to form a reinforced edge 711. The reinforced edge 711 provides enhanced rigidity of the guide member 70.

A shown in FIG. 3, the base portion 71 is concaved at appropriate positions in the respective longitudinal or transverse edge regions thereof to form a pair of depressed areas 74 each having a rectangular shape in top plan view. Each of the depressed areas 74 has a flat bottom 741 concaved from the upper surface of the base portion 71 at 2 to 3 mm, and an inclined wall 742 extending from the right, left and front sides of the bottom 741 when seeing from the upstream side, to the upper surface of the base portion 71, at a gentle slope. In relation to the depressed areas 74, two regions of the reinforced edge 711 corresponding to the depressed areas 74 are concaved downward along the bottom 741 and the inclined wall 742.

The right and left depressed areas 74 are arranged such that the distance between the distant or outward edges of the right and left bottoms 741 is set slightly less than the lateral length of a minimum-size sheet (e.g. B5 size sheet) among various sheets P2, and the distance between the adjacent or inward edges of the right and left bottoms 741 is set slightly greater than the lateral length of a maximum-size sheet (e.g. A3 size sheet) among sheets P2 to be fed.

Thus, the opposite transverse edges, or the edges extending in a direction orthogonal to the transport direction, of a sheet P2 fed from the transfer belt 42 bend downward to contact the bottoms 741 of the pair of right and left depressed areas 74, respectively.

Further, a pair of ribs 75 are standingly formed in the longitudinally or transversely central region of the base portion 71 and the inclined plate 72 to extend in the transport direction. Thus, the transversely central region of a sheet P2 fed from the transfer belt 42 to the guide member 70 is slightly lifted from the upper surface of the base portion 71. In this embodiment, each of the ribs 75 is set to have a height in the range of 1 to 3 mm.

As shown in FIG. 2, the oblique angle $\alpha$ of the inclined plate 72 relative to the base portion 71 is set in the range of 25-degree to 35-degree. Further, the guide member 70 is mounted in a given posture allowing an oblique angle $\beta$ of the inclined plate 72 relative to a direction of the tangent L to the fixing roller 51 in the nip zone 56 between the fixing roller 51 and the pressure roller 52 to be set in the range of 25-degree to 35-degree. In this embodiment, the oblique angles $\alpha$ and $\beta$ are set at the same value (about 27-degree). Since the opposite angles are set at the same value, the angle of the tangent to the fixing roller 51 in the nip zone 53 extends in parallel with the base portion 71.

The reason that the oblique angle $\beta$ of the inclined plate 72 relative to a direction of the tangent L to the fixing roller 51 in the nip zone 56 is set in the range of 25-degree to 35-degree is determined based on various experimental tests as described in the column "Example" later in detail.

The guide member 70 is also mounted at a given position allowing the downstream edge of the inclined plate 72 to be located slightly above the tangent L.

The fixing roller 51 in opposed relation to the downstream edge of the guide member 70 is formed in a so-called reverse-crown (bow-tie-like, concave or reverse-tapered) shape whose diameter is gradually reduced in a direction extending from each of the opposite transverse ends to the central region of the fixing roller. Thus, when a sheet P is sandwiched by the nip zone 53 defined between the fixing roller 51 having rigidity and the pressure roller 52 made of an elastically deformable soft material, and fed according to the rotations of the fixing and pressure rollers, a portion of the sheet P in contact with the end region of the fixing roller 51 is moved at a distance greater than that another portion the sheet P in contact with the central region of the fixing roller 51 (because the edge region has a larger diameter than that of the central region). Due to this imbalance, the sheet P2 receives forces oriented outward in opposite directions. The tension arising from these opposite polling forces prevents the sheet P2 from being crimpled.

In this embodiment, the downstream edge of the inclined plate 72 is formed in an outward convexed gentle arc shape (or crown shape) conformable to the reverse-crown shape of the fixing roller 51. This crown-shaped arc edge 722 allows the leading edge of the sheet P2 guided by the inclined plate 72 to be smoothly fed toward the reverse-crown-shaped peripheral surface of the fixing roller 51.

In this embodiment, the crown-shaped arc edge 722 of the inclined plate 72 has a curvature radius smaller by a factor of 1/100 to 1/50 as compared with the curvature radius of the reverse-crown shape of the fixing roller 51 (to be precise, a curvature radius of an arc-shaped curve defined by the intersection between a plane including the axis of the fixing roller 51 and the peripheral surface of the fixing roller 51).

Specifically, given that the length of the fixing roller 51 is about 330 mm, and the curvature radius of the reverse-crown shape of the fixing roller 51 is about 1000 mm, the curvature radius of the arc edge 722 of the inclined plate 72 is derived by subtracting a value in the range of 1/100 to 1/50 of 1000 mm from 1000 mm, or set in the range of 980 mm to 990 mm. According to the guide member arranged in this manner, the leading edge of the sheet P2 can be guided toward the nip zone 53 in conformity to the reverse-crown shape of the fixing roller, and be reliably nipped by the nip zone 53. Thus, crimples and bouncing of the sheet P2 can be effectively suppressed.

The reason that the oblique angle $\beta$ of the inclined plate 72 relative to a direction of the tangent L to the fixing roller 51 in the nip zone 56 is set in the range of 25-degree to 35-degree.

The curvature radius of the crown-shaped arc edge 722 of the inclined plate 72 is set at a value smaller by a factor of 1/100 to 1/50 as compared with the curvature radius of the reverse-crown shape of the fixing roller 51 by the following reason. If the curvature radius of the inclined plate 72 is short by less than 1/100 as compared with the curvature radius of the fixing roller 51, the gap between the arc edge 722 of the inclined plate 72 and the peripheral surface of the fixing roller 51 becomes too narrow to cause difficulty in allowing a sheet P2 to pass therethrough. If the curvature radius of the inclined plate 72 is short by greater than 1/50 as compared with the curvature radius of the fixing roller 51, the gap between the arc edge 722 of the inclined plate 72 and the peripheral surface of the fixing roller 51 becomes too broad to cause difficulty in allowing a sheet P2 to be reliably fed.

Further, the transport surface of the guide member 70 made of metal, such as iron or alloy, is coated with synthetic resin having lubricity. This transport surface allows the sheet P2 to be smoothly moved thereon.

The synthetic resin serves as the coating may include typical olefin-based synthetic resins such as polyethylene or polypropylene, and polyamide-based synthetic resins, preferably fluororesin such as polytetrafluoroethylene, and silicone resin. Preferably, a conductive material, such as carbon black, is dispersedly contained in the synthetic resin to give adequate conductivity to the guide member 70.

As mentioned above in detail, the nipping mechanism according to the above embodiment of the present invention is applied to the image forming apparatus 10 comprising the transfer section 40 including the transfer belt 42 transporting a sheet P2 having a toner image transferred thereonto through the photosensitive drum 41, the fixing section 50 including the fixing roller 51 and the pressure roller 52 which are disposed on the side of the downstream end of the transfer belt 42 of the transfer section 40 and vertically aligned in a paired manner to define therebetween the nip zone 53 for nipping the sheet P2, and the guide member 70 disposed between the nip zone 53 and the downstream end of the transfer belt 42. The fixing roller 51 is formed in a reverse-crown shape whose diameter is gradually reduced in a direction extending from each of the opposite transverse ends to the central region of the fixing roller 51, and the guide member 70 has an edge disposed in opposed relation to the nip zone 53 and formed in a crown shape conformable to the reverse-crown shape.

Thus, a sheet P2 fed from the transfer belt 42 toward the fixing section 50 is moved toward the nip zone 53 defined between the fixing roller 51 and the pressure roller 52 while being guided by the guide member 70, and subjected to a given fixing treatment in the fixing section 50 while being nipped by the nip zone 53.

Further, the fixing roller 51 is formed in a reverse-crown shape, and the arc edge 722 of the guide member 70 disposed in opposed relation to the nip zone 53 is formed in a crown shape. Thus, during the course of the feeding through the guide member 70 in advance of the nipping, the leading edge of the sheet P2 is curved according to the crown shape of the guide member 70 in conformity to the reverse-crown shape of the fixing roller 51, so as to feed the sheet P2 to the nip zone 53 smoothly along the peripheral surface of the fixing roller 51.

In a conventional guide member, the leading edge of a sheet P2 fed through the guide member does not have a shape conformable to the reverse-crown shape of the fixing roller 51. Thus, the leading edge of the sheet P2 is not adequately brought into contact with the peripheral surface of the fixing roller 51, and an uneven force resultingly applied to the leading edge of the sheet P2 causes the problem of the occurrence of crimples on the sheet P2. By contrast, in the present invention, the guide member 70 having a downstream edge of formed in a crown shape can effectively suppress the above problem.

In the sheet nipping mechanism according to the above embodiment, the guide member 70 includes the base portion 71 extending approximately parallel with the transport surface 43 of the transfer belt 42, and the inclined plate 72 extending obliquely upward from the downstream end of the base portion 71 toward the nip zone 53. The oblique angle of the inclined plate 72 is set in the range of 25-degree to 35-degree relative to the direction of the tangent to the fixing roller 51 in the nip zone 53. Thus, the leading edge of a sheet P2 fed from the transfer belt 42 toward the fixing section 50 is first moved onto the base portion 71 of the guide member 70, and then moved toward the fixing section 50 through the inclined plate. Thus, as compared to a conventional nipping mechanism including a guide member having a linear shape in side view, which has only the inclined plate 72 but no base portion 71, the above sheet feeding mechanism can prevent the angle of the sheet from being suddenly changed to allow the moving direction of the sheet P2 to be smoothly changed.

Further, based on the result of various experimental tests, the oblique angle of the inclined plate 72 is set in the range of 25-degree to 35-degree relative to the direction of the tangent to the fixing roller 51 in the nip zone 53, so as to effectively prevent the crimples and bouncing of the sheet P2.

Furthermore, the curvature radius of the crown-shaped arc edge of the inclined plate 72 is set at a value smaller by a factor of 1/100 to 1/50 as compared with that of the reverse-crown arc shape of the fixing roller 51. Thus, the gap between the peripheral surface of the fixing roller 51 and the inclined plate 72 of the guide member 70 disposed in opposed relation to the peripheral surface becomes approximately constant over its entire longitudinal length, so as to smoothly feed the sheet P2 to the nip zone 53.

The guide member 70 has a metal substrate having a surface coated with a synthetic resin having lubricity. This coating layer allows the sheet P2 to be more smoothly guided.

The sheet-feeding surface of the guide member 70 is formed with the plurality of ribs 75 each extending in a sheet-feeding direction. The ribs 75 can reduce the contact area of the guide member 70 with the sheet P2 (or line contact instead of surface contact), and the frictional resistance of the guide member 70 can be reduced accordingly. Further, the ribs 75 extending in the sheet-feeding direction can prevent the transverse displacement of the sheet P2. Thus, the guide member 70 can bring out a further enhanced function of smoothly guiding the sheet P2.

The sheet-feeding surface of the guide member 70 has the pair of depressed areas 74 formed, respectively, in the opposite transverse edge regions thereof, and the depressed areas is designed such that when each of a plurality of sheets P2 having different sizes ranging from a minimum size to a maximum size is fed onto the guide member 70, the opposite transverse edges of the sheet P2 are allowed to be located within the range of the corresponding depressed areas 74. Thus, during the course of the feeding through the guide member 70, the opposite transverse edges on the side of the leading edge of the sheet P2 fall in the corresponding depressed areas 74. Then, the transverse edges are moved forward or downstream while being in close contact with the surface of the guide member 70 to prevent scattered toner particles from entering between the sheet P2 and the surface of the guide member 70, so that the rear surface of the sheet P2 can avoid contaminations caused by the scattered toner particles.

The image forming apparatus 10 incorporates the above sheet nipping mechanism. Thus, the fixing treatment to the sheet P2 can be adequately performed while effectively preventing the problem of crimples otherwise occurring in the sheet P fed toward the fixing section 50, so as to provide the finished sheet P2 having a transferred toner image with excellent image quality and without crimples.

It is understood that the present invention is not limited to the above embodiment, but various changes and modifications may be made without departing from the spirit and scope of the present invention as set forth in appended claims.

For example, (1) While the image forming apparatus 10 in the above embodiment is designed to transfer a monochrome image, the present invention is not limited to the monochrome image forming apparatus, but may be applied to a multicolor image forming apparatus.

(2) While the image read section 30 in the above embodiment is designed to output a read document image directly to the photosensitive drum 41 of the transfer section 40 in the form of analog information (or light intensity), the present invention is not limited to the image forming apparatus having the analogue-type image read section 30, but maybe applied to an image forming apparatus having a digital-type image read section in which read image information is converted into a digital signal, and an electrostatic image is formed on the peripheral surface of the photosensitive drum 41 based on the digital signal.

(3) While the above embodiment employs the pilot member 44 provided between the transfer belt 42 and the guide member 44, the pilot member 44 is not essential, but the sheet P2 may be fed directly to the guide member 70 from the transfer belt 42 without the pilot member 44.

(4) While the above embodiment employs the two line-shaped ribs extending over the base portion 71 and the inclined plate 72 of the guide member 70, the number of line-shaped ribs is not limited to two, but may be one, or three or more.

EXAMPLE

In order to check the effect of the inventive construction, a test was carried out in which a sheet P2 was actually transported through the guide member 70 and subjected to the fixing treatment in the fixing section 50 while variously changing the angle (tangent angle to nip zone) defined between the inclined plate 72 of the guide member 70 and a direction of the tangent to the fixing roller 51 in the nip zone 53, and the curvature radius of the arc edge 722 of the inclined plate 72. The test conditions are as follows.

[Test Conditions]

(i) roller width (length) of fixing roller 51: length capable of feeding an A3-size sheet in a longitudinal feed (about 340 mm)

(ii) sheet-feed speed: about 388 mm/sec (iii) fixing roller 51: metal roller body having a peripheral surface coated with conductive PFA (hexafluoropropylene) and PTFT (polytetrafluoroethylene), diameter: 55 mm (iv) amount of reverse crown in fixing roller 51: a value derived from the following formula:

$$[((A+C)/2)-B]$$

wherein A is the diameter of one of the ends of a portion of the fixing roller 51 formed as reverse crown, B is the diameter of the other end of the reverse-crown portion, and C is the diameter of the center of the reverse-crown portion.

(v) pressure roller 52: non-conductive silicon rubber roller body having a peripheral surface fitted with PFA tube, diameter: 40 mm (vi) sheet (total 6 types):

A3-size, METSUKE (weight/unit area): 64 g/m$^2$ and 80 g/m$^2$ (2 types),

A4-size, METSUKE: 64 g/m$^2$, 160 g/m$^2$ and 45 g/m$^2$ (3 types), (vii) tangent angle to nip zone:

0° to 15°, 25° to 35°, 45° to 55°, (viii) decrement of curvature radius of arc edge 722 relative to curvature radius of reverse crown of fixing roller 51: less than 1/100, 1/100 to 1/50, and greater than 1/50 (3 ranges)

Under the above conditions, the sheet P2 was fed to the fixing section 50 through the guide member 50 to observe the state of occurrence of crimples and creases. The test result is shown in Table 1. In Table 1, "CP", "CS" and "OK" indicate the occurrence of crimples, the occurrence of creases, and none of crimples and creases, respectively. "Non-Insertion" indicates that the sheet could not be inserted between the fixing roller 51 and the pressure roller 52.

TABLE 1

| sheet type | tangent angle to nip zone (degree) | decrement of curvature radius of arc edge of inclined plate of guide member: less than 1/100 | 1/50 to 1/100 | greater than 1/50 |
|---|---|---|---|---|
| A3 | 0–15 | CP | CP | CP |
| METSUKE | 25–35 | CP | OK | CP |
| 64 g/m$^2$ | 45–55 | CS | CS | CS |
| A3 | 0–15 | CP | OK | CP |
| METSUKE | 25–35 | OK | OK | OK |
| 80 g/m$^2$ | 45–55 | CS | CS | CS |
| A4 | 0–15 | OK | OK | CP |
| METSUKE | 25–35 | OK | OK | OK |
| 64 g/m$^2$ | 45–55 | OK | OK | OK |
| A4 | 0–15 | OK | OK | OK |
| METSUKE | 25–35 | OK | OK | OK |
| 160 g/m$^2$ | 45–55 | Non-Insertion | Non-Insertion | Non-Insertion |
| A4 | 0–15 | CP | CP | CP |
| METSUKE | 25–35 | OK | OK | CP |
| 45 g/m$^2$ | 45–55 | CP | CP | CP |

As seen in Table 1, in case that the tangent angle to nip zone is in the range of zero to 15 degrees using the A3-size sheets, the occurrence of crimples was observed irrespective of increase in the curvature radius. In case that the tangent angle to nip zone is in the range of 45 to 55 degrees using the A3-size sheets, the occurrence of creases was observed in all cases.

In case of the A4-size sheets, except for some cases (A4, METSUKE: 64 g/m$^2$, 0 to 15-degree, greater than 1/50), all of the remaining cases exhibit the same behavior, and it is proved that a thin sheet is highly likely to have crimples. Further, it was proved that no crease occurs in the A4-size sheets.

In case that the tangent angle to nip zone is in the range of 25 to 35 degrees, and the decrement of curvature radius is in the range of 1/100 to 1/50, all cases were evaluated as "OK", which shows that none of crimples and creases cured. This means that the occurrence of crimples and creases in the sheets P2 can be prevented by setting the tangent angle to nip zone in the range of 25 to 35 degrees, and the decrement of curvature radius of arc edge 722 of the inclined plate 72 relative to curvature radius of reverse crown of fixing roller in the range of 1/100 to 1/50.

As mentioned above in detail, correspondingly to the fixing roller 51 formed in a reverse-crown shape whose diameter is gradually reduced in a direction extending from each of the opposite transverse ends to the central region of the fixing roller, the edge of the guide member 70 disposed in opposed relation to the nip zone 53 is formed in a crown shape conformable to the reverse-crown shape of the fixing roller 51. Thus, a sheet P2 fed from the transfer belt 42 toward the fixing section 50 is moved toward the nip zone 53 defined between the fixing roller 51 and the pressure roller 52 while being guided by the guide member 70, and subjected to a fixing treatment while being nipped by the nip zone 53. During the course of the feeding through the guide member in advance of the nipping, the leading edge of the sheet P2 is curved according to the crown shape of the guide member in conformity to the reverse-crown shape of the fixing roller 51, so as to feed the sheet P2 to the nip zone 53 smoothly along the peripheral surface of the fixing roller 51.

In a conventional guide member 70 whose downstream edge is not formed in a crown shape, the leading edge of a sheet P2 fed through the guide member does not have a shape conformable to the reverse-crown shape of the fixing roller 51. In a conventional guide member, the leading edge of a sheet P2 fed through the guide member does not have a shape conformable to the reverse-crown shape of the fixing roller 51. Thus, the leading edge of the sheet P2 is not adequately brought into contact with the peripheral surface of the fixing roller 51, and an uneven force resultingly applied to the leading edge of the sheet P2 causes the problem of the occurrence of crimples on the sheet P2. By contrast, in the present invention, the guide member 70 having a downstream edge of formed in a crown shape can effectively suppress the above problem, so as to provide the high-quality sheet P2 having a transferred toner image.

As described above, a sheet nipping mechanism comprises a transport device for transporting a sheet having a toner image transferred thereonto through a photosensitive drum, a fixing device including a fixing roller and a pressure roller which are disposed on the side of the downstream end of the transport device and vertically aligned in a paired manner to define a nip zone therebetween, and a guide member disposed between the nip zone and the downstream end of the transport device. In this sheet nipping mechanism, the fixing roller is formed in a reverse-crown shape whose diameter is gradually reduced in a direction extending from each of the opposite transverse ends to the central region of the fixing roller. Further, the guide member has a downstream edge which is disposed in opposed relation to the peripheral surface of the fixing roller adjacent to the nip zone, and formed as a crown-shaped arc edge designed to allow the gap between the peripheral surface and the downstream edge to be set at an approximately constant value over its entire longitudinal length.

In the nipping mechanism constructed as above, a sheet fed from the transport device toward the fixing device is moved to the nip zone defined between the fixing and pressure rollers while being guided by the guide member, and subjected to a fixing treatment while being nipped by the nip zone.

Further, the fixing roller is formed in the reverse-crown shape, and the downstream edge of the guide member disposed in opposed relation to the fixing roller at a position adjacent to the nip zone is formed in the crown shape, so that the gap between the peripheral surface of the fixing roller and the downstream edge of the guide member is set at an approximately constant value over its entire longitudinal length. Thus, during the course of the feeding through the guide member in advance of the nipping, the leading edge of the sheet is curved according to the crown shape of the guide member in conformity to the reverse-crown shape of the fixing roller, so as to feed the sheet to the nip zone smoothly along the peripheral surface of the fixing roller.

In a conventional guide member whose downstream edge is not formed in a crown shape, the leading edge of a sheet fed through the guide member does not have a shape conformable to the reverse-crown shape of the fixing roller. Thus, the leading edge of the sheet is not brought into contact, particularly, with the central region of the guide member where the gap between the peripheral surface of the fixing roller and the downstream edge of the guide member, and an uneven force resultingly applied to the central region of the leading edge of the sheet causes the problem of the occurrence of crimples on the sheet. By contrast, the inventive nipping mechanism having the guide member whose downstream edge is formed in the crown shape can effectively suppress the above problem.

In the inventive sheet nipping mechanism, the guide member may include a base portion extending approximately parallel with the transport surface of the transport device, and an inclined portion extending obliquely upward from the downstream end of the base portion toward the nip zone. The oblique angle of the inclined portion may be set in the range of 25-degree to 35-degree relative to a direction of the tangent to the fixing roller in the nip zone.

According to this arrangement, the leading edge of a sheet fed from the transport device toward the fixing device is first moved onto the base portion of the guide member, and then moved toward the fixing device through the inclined portion. Thus, as compared to a conventional nipping mechanism including a guide member which has only an inclined portion but no base portion, the above sheet feeding mechanism can prevent the angle of the sheet from being suddenly changed to allow the moving direction of the sheet to be smoothly changed, so that crimples and bouncing of the sheet can be effectively prevented.

Further, the crimples and bouncing of the sheet can be effectively prevented by setting the oblique angle of the inclined portion in the range of 25-degree to 35-degree relative to a direction of the tangent to the fixing roller in the nip zone. This range of the oblique angle was obtained through various tests carried out to verify the effect on the change in the oblique angle.

In the inventive sheet nipping mechanism, the crown-shaped arc edge of the inclined portion may have a curvature radius smaller by a factor of 1/100 to 1/50 as compared with that of the reverse-crown arc shape of the fixing roller.

The arc edge of the guide member having a curvature radius smaller by a factor of 1/100 to 1/50 as compared with that of the reverse-crown arc shape of the fixing roller specifically allows the gap between the downstream edge of the guide member and the peripheral surface of the fixing roller to be set at an approximately constant value over its entire longitudinal length while matching the curvature center of the arc edge of the guide member and the curvature center of the reverse-crown arc shape of the fixing roller, so as to smoothly feed the sheet to the nip zone.

In the inventive sheet nipping mechanism, the guide member may have a metal substrate having a surface coated with a synthetic resin which has lubricity and contains a conductive material In this case, the guide member can more smoothly guide a sheet by taking advantage of the synthetic resin having lubricity and containing a conductive material (for discharging static electricity therethrough), which is coated on the surface thereof.

In the inventive sheet nipping mechanism, the guide member may have a sheet-feeding surface formed with a plurality of ribs each extending in a sheet-feeding direction. The ribs can reduce the contact area of the guide member with a sheet, and the frictional resistance of the guide member to the sheet can be reduced accordingly. Further, the ribs extending in the sheet-feeding direction can prevent the transverse displacement of the sheet. Thus, the guide member can bring out a further enhanced function of smoothly guiding a sheet.

In the inventive sheet nipping mechanism, the guide member may have a sheet-feeding surface including a pair of depressed areas formed, respectively, in the opposite transverse edge regions thereof, and the depressed areas may be designed such that when each of a plurality of sheets having different sizes ranging from a minimum size to a maximum size is fed onto the guide member, the opposite transverse edges of the sheet are allowed to be located within the range of the corresponding depressed areas. In this case, during the course of the feeding through the guide member, the opposite transverse edges on the side of the leading edge of a sheet fall in the corresponding depressed areas. Then, the transverse edges are moved forward or downstream while being in close contact with the surface of the guide member to prevent scattered toner particles from entering between the sheet and the surface of the guide member, so that the rear surface of the sheet can avoid contaminations caused by the scattered toner particles.

An image forming apparatus incorporating the inventive sheet nipping mechanism can obtain the above functions and effects.

This application is based on patent application No. 2003-133333 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet nipping mechanism for accommodating sheets of a plurality of different sizes ranging from a minimum size which is at least as small as a B5 size sheet to a maximum size which is at least as large as an A3 size sheet comprising:

a transport device for transporting a sheet having a toner image transferred thereonto through a photosensitive drum;

a fixing device including a fixing roller and a pressure roller downstream of the transport device and vertically aligned in a paired manner to define a nip zone therebetween; and a guide member disposed between the nip zone and a downstream end of the transport device, wherein the fixing roller is formed in a reverse-crown shape whose diameter is gradually reduced in a direction extending from each of the opposite transverse ends to the central region of the fixing roller, and the guide member having an upstream edge in opposed relation to the transport device, a downstream edge in opposed relation to a peripheral surface of the fixing roller adjacent to the nip zone, and a sheet-feeding surface extending substantially between the upstream and downstream edges for receiving a sheet transported from the transport device, the sheet-feeding surface including a pair of depressed areas receding from the sheet-feeding surface and formed in opposite transverse edge regions in proximity to the upstream edge thereof, the depressed areas being designed such that when any of the sheets having the different sizes ranging from the minimum size at least small as the B5 size sheet to the maximum size at least as large as the A3 size sheet is fed onto the guide member, opposite transverse edges of the sheet are allowed to be located within a range of the corresponding depressed areas, the downstream edge being formed as a crown-shaped arc edge designed to allow the gap between the peripheral surface and the downstream edge to be set at an approximately constant value over its entire longitudinal length.

2. The sheet nipping mechanism as defined in claim 1, wherein the guide member includes a base portion extending approximately parallel with the transport surface of the transport device, and an inclined portion extending obliquely upward from a downstream end of the base portion toward the nip zone, wherein the oblique angle of the inclined portion is set in the range of 25-degree to 35-degree relative to a direction of a tangent to both the fixing roller and the pressure roller in the nip zone.

3. The sheet nipping mechanism as defined in claim 2, wherein the crown-shaped arc edge of the inclined portion has a curvature radius smaller by a factor of 1/100 to 1/50 as compared with that of the reverse-crown arc shape of the fixing roller.

4. The sheet nipping mechanism as defined in claim 1, wherein the guide member has a metal substrate having a surface coated with a synthetic resin which has lubricity and contains a conductive material.

5. The sheet nipping mechanism as defined in claim 4, wherein the sheet-feeding surface is formed with a plurality of ribs each extending in a sheet-feeding direction.

6. An image forming apparatus comprising the sheet nipping mechanism as defined in claim 1.

7. A sheet nipping mechanism comprising:

a transport device having a transport surface for transporting a sheet having a toner image transferred thereonto through a photosensitive drum;

a fixing device including a fixing roller and a pressure roller which are disposed downstream of the transport device and vertically aligned in a paired manner to define a nip zone therebetween, the fixing roller being formed in a reverse-crown shape and having a diameter that is gradually reduced in a direction extending from each of the opposite transverse ends to a central region of the fixing roller; and a guide member disposed between the nip zone and a downstream end of the transport device, the guide member having an upstream edge in opposed relation to the transport device and a downstream edge in opposed relation to a peripheral surface of the fixing roller adjacent to the nip zone, the downstream edge being formed as a crown-shaped arc edge designed to allow the gap between the peripheral surface and the downstream edge to be set at an approximately constant value over its entire longitudinal length, the guide member including a base portion adjacent the upstream edge and extending approximately parallel with the transport surface of the transport device and an inclined portion extending obliquely up from a downstream end of the base portion towards the nip zone, the inclined portion being aligned to the base portion at an oblique angle in a range of 25-degree to 35-degree relative to a direction of a tangent to both the fixing roller and the pressure roller in the nip zone, the guide member having a sheet-feeding surface for accommodating sheets of a plurality of different sizes ranging from a minimum size which is at least as small as a B5 size sheet to a maximum-size sheet which is at least as large as an A3 size sheet and including a pair of depressed areas formed, respectively, in the opposite transverse edge regions thereof, the depressed areas being designed such that when any of the sheets having the different sizes ranging from the minimum size to the maximum size is fed onto the guide member, the opposite transverse edges of the sheet are allowed to be located within a range of the corresponding depressed areas.

8. The sheet nipping mechanism as defined in claim 7, wherein the crown-shaped arc edge of the inclined portion has a curvature radius smaller by a factor of 1/100 to 1/50 as compared with that of the reverse-crown arc shape of the fixing roller.

9. The sheet nipping mechanism as defined in claim 7, wherein the guide member has a metal substrate having a surface coated with a synthetic resin which has lubricity and contains a conductive material.

10. The sheet nipping mechanism as defined in claim 7, wherein the guide member has a sheet-feeding surface formed with a plurality of ribs each extending in a sheet-feeding direction.

11. The sheet nipping mechanism as defined in claim 7, wherein substantially all areas of the sheet-feeding surface between the depressed areas are at positions spaced higher than the depressed areas.

12. The sheet nipping mechanism as defined in claim 11, wherein the sheet feeding surface has at least one rib between the depressed areas.

13. The sheet nipping mechanism as defined in claim 12, wherein all areas of the sheet feeding surface spaced from the at least one rib and from the depressed areas are substantially plate shaped.

14. The sheet nipping mechanism as defined in claim 13, wherein the at least one rib projects up from the plate-shaped surface by a distance of 1–3 mm.

15. The sheet nipping mechanism as defined in claim 7, wherein the tangent is perpendicular to a plane passing through the axes of the fixing roller and the pressure roller.

16. A sheet nipping mechanism comprising:

a transport device for transporting a sheet having a toner image transferred thereonto through a photosensitive drum;

a fixing device including a fixing roller and a pressure roller downstream of the transport device and vertically aligned in a paired manner to define a nip zone therebetween, fixing roller being formed in a reverse-crown shape whose diameter is gradually reduced in a direction extending from each of the opposite transverse ends to the central region of the fixing roller; and a guide member disposed between the nip zone and a downstream end of the transport device, the guide member having an upstream edge in opposed relation to the transport device, a downstream edge in opposed relation to a peripheral surface of the fixing roller adjacent to the nip zone, and substantially plate-shaped sheet-feeding surface extending substantially between the upstream and downstream edges for receiving a sheet transported from the transport device, a pair of depressed areas receding from the substantially plate-shaped sheet-feeding surface in opposite transverse edge regions in proximity to the upstream edge thereof, the depressed areas being dimensioned and disposed so that when each of a plurality of sheets having different sizes ranging from a minimum size to a maximum size is fed onto the substantially plate-shaped sheet-feeding surface of the guide member, opposite transverse edges of the sheet are allowed to bend down into the corresponding depressed areas, while portions of the sheet between the depressed areas are supported on the sheet-feeding surface without bending down, and the downstream edge being formed as a crown-shaped arc edge designed to allow the gap between the peripheral surface and the downstream edge to be set at an approximately constant value over its entire longitudinal length.

17. The sheet nipping mechanism as defined in claim 16, wherein the plate-shaped sheet-feeding surface is formed with a plurality of ribs each extending in a sheet-feeding direction and disposed substantially centrally between the depress areas.

18. The sheet nipping mechanism as defined in claim 17, wherein all areas of the sheet-feeding surface adjacent to the upstream edge thereof except for the depress areas and the ribs are substantially planar.

19. The sheet nipping mechanism as defined in claim 17, wherein the at least one rib projects up from the plate-shaped surface by a distance of 1–3 mm.

* * * * *